US007000774B2

(12) United States Patent
Bryant

(10) Patent No.: US 7,000,774 B2
(45) Date of Patent: Feb. 21, 2006

(54) UNIVERSAL PACKAGING FOR HAND-HELD ELECTRONIC DEVICES AND ACCESSORIES

(76) Inventor: Dominic Bryant, 31 Bell Lane, Hoddesdon Herts EN1 7HG (GB)

( * ) Notice: Subject to any disclaimer, the term of this patent is extended or adjusted under 35 U.S.C. 154(b) by 179 days.

(21) Appl. No.: 10/653,575

(22) Filed: Sep. 2, 2003

(65) Prior Publication Data

US 2005/0045525 A1 Mar. 3, 2005

(51) Int. Cl.
*B65D 25/54* (2006.01)

(52) U.S. Cl. ..... 206/769; 206/777; 206/320; 206/583; 229/120.26; 229/120.38

(58) Field of Classification Search ..... 229/120.25, 229/120.26, 120.27, 120.37, 120.38; 206/320, 206/756, 764, 769, 583, 777
See application file for complete search history.

(56) References Cited

U.S. PATENT DOCUMENTS 2,948,455 A * 8/1960 Frankenstein ..... 229/120.21
4,026,411 A * 5/1977 Johnson ..... 206/784
4,320,867 A * 3/1982 Gardner ..... 229/120.26
5,351,819 A * 10/1994 Varon ..... 206/232
5,413,274 A * 5/1995 Forbes, Jr. ..... 229/162.1
6,371,364 B1 4/2002 Maillot

FOREIGN PATENT DOCUMENTS

JP 2000-335558 * 12/2000

* cited by examiner

*Primary Examiner*—David T. Fidei
(74) *Attorney, Agent, or Firm*—Mark D. Bowen, Esq.; Stearns, Weaver, Miller, Weissler Alhadeff & Sitterson, P.A.

(57) ABSTRACT

A universal packaging solution for use in packaging cellular telephones and other hand-held electronic devices in cartons adapted with an insert formed from a single piece of cardboard that is die-cut and folded so as to form a packaging container suitable for housing a wide variety of cellular telephones and accessories. Once folded into the intended configuration, the packaging insert defines a chamber having a transparent window for receiving the device, and a base for maintaining the device within a box in a configuration that allows for visual inspection of the device while preventing damage to the device as a result of shock during transit. The packaging insert further includes a plurality of apertures strategically located and spaced for receiving and securing accessories, such as charging units, therein so as to anchor the accessories within the packaging.

4 Claims, 9 Drawing Sheets

UNIVERSAL PACKAGING FOR HAND-HELD ELECTRONIC DEVICES AND ACCESSORIES

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to packaging materials, and more particularly to the packaging of cellular telephones and accessories.

2. Description of the Background Art

The use of cellular telephones and other portable hand-held electronic devices has increased rapidly in recent years thereby resulting in a sharp increase in sales of cellular telephones and portable electronic devices. One problem experienced in connection with the sale of such devices relates the packaging requirements. Since cellular telephones, as well as a host of portable electronic devices, come in wide variety of shapes and sizes, manufacturers have been forced to develop individualized packaging solutions to accommodate the unique shapes of the various devices. One commonly employed solution is to package the device in standard box-type packaging, such as a carton, along with cushioning material, such as bubble wrap or foam to secure the device within the oversized carton.

Accordingly, there exists a need for a universal packaging solution to facilitate the packaging of various sizes of portable hand-held electronic devices.

The present invention relates to the packaging of various sizes of cellular telephones and other hand-held electronic devices.

SUMMARY OF THE INVENTION

The present invention provides a universal packaging solution for use in packaging cellular telephones and other hand-held electronic devices in cartons adapted with an insert formed from a single piece of cardboard that is die-cut and folded so as to form a packaging container suitable for housing a wide variety of cellular telephones and accessories. Once folded into the intended configuration, the packaging insert defines a chamber having a transparent window for receiving the device, and a base for maintaining the device within a box in a configuration that allows for visual inspection of the device while preventing damage to the device as a result of shock during transit. The packaging insert further includes a plurality of apertures strategically located and spaced for receiving and securing accessories, such as charging units, therein so as to anchor the accessories within the packaging.

Accordingly, it is an object of the present invention to provide improved packaging for cellular telephones and other hand-held electronic devices.

Another object of the present invention is to provide a universal package insert for use with electronic devices of various sizes and shapes.

Still another object of the present invention is to provide improvements in the field of electronic device packaging.

DETAILED DESCRIPTION OF THE INVENTION

I. Preferred Embodiment

FIGS. 1–6 depict a universal packaging carton insert, generally referenced as 10, for use in packaging cellular telephones and other hand-held electronic devices in cartons adapted with an insert formed from a single piece of cardboard that is die-cut and folded so as to form a packaging container suitable for housing a wide variety of cellular telephones and accessories.

Figure 1:
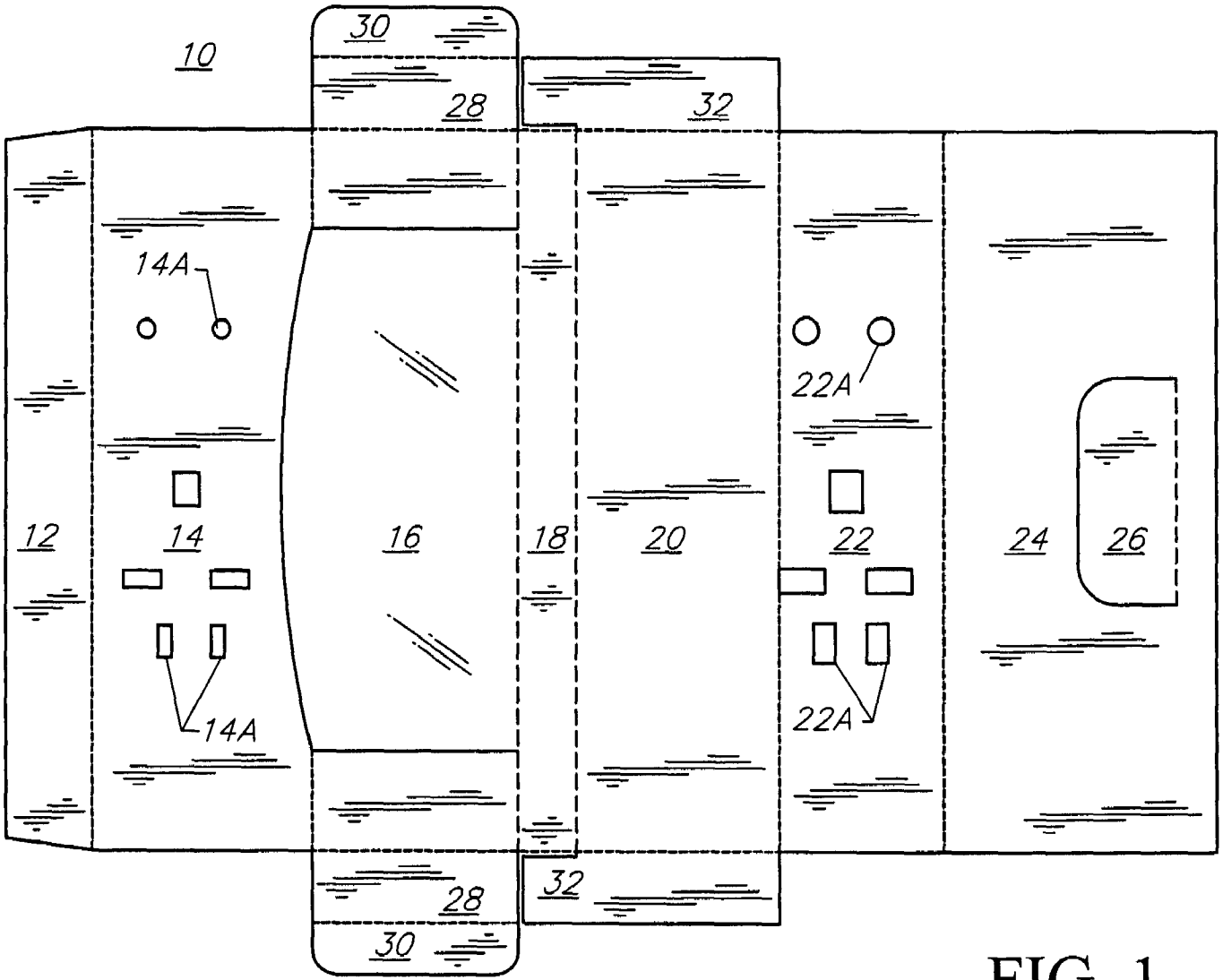
FIG. 1 is a top plan view of a die-cut package insert according to the present invention.
Figure 2:
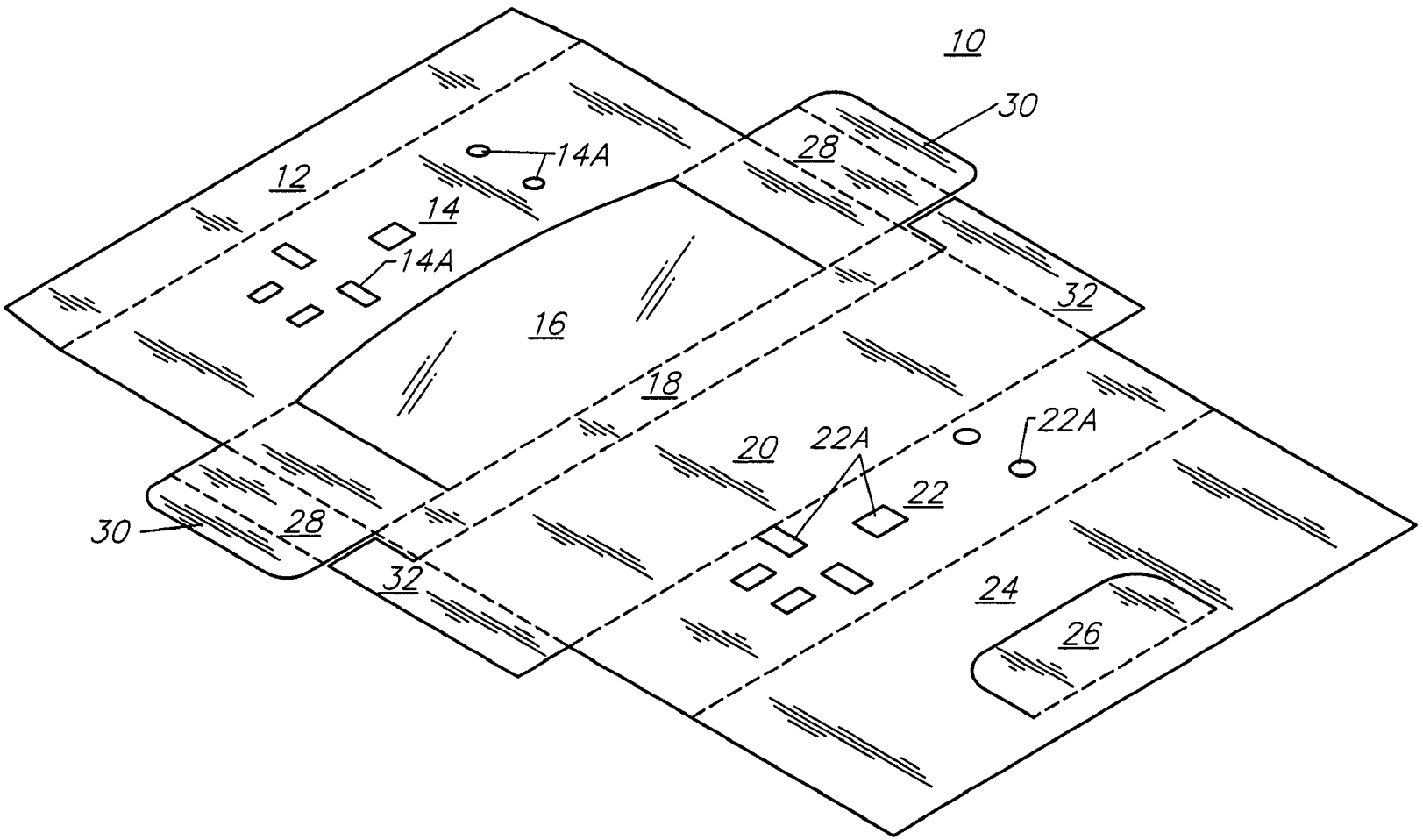
FIG. 2 is a perspective view thereof.
Figure 3:
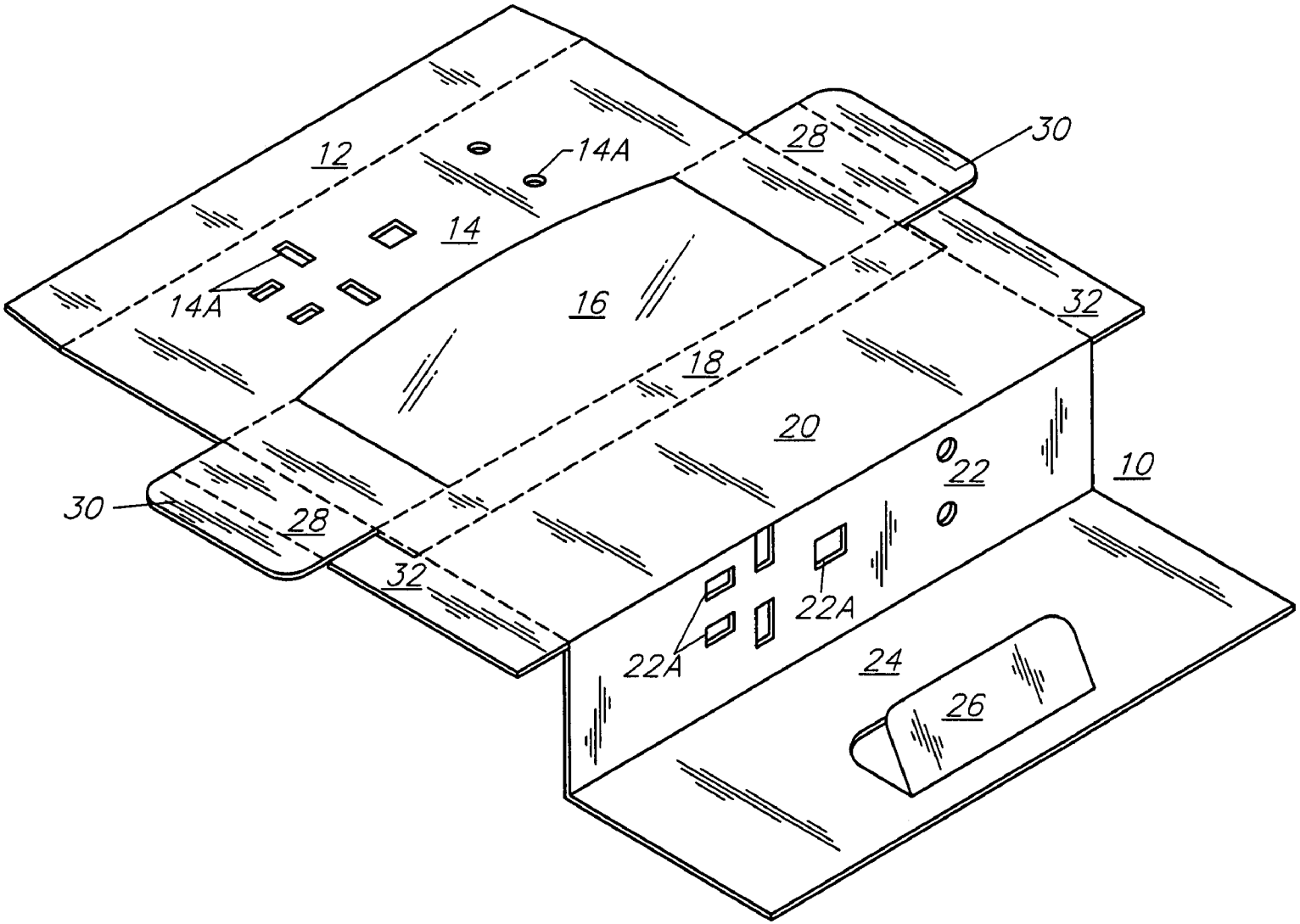
FIG. 3 is a perspective view illustrating a first partially assembled configuration.
Figure 4:
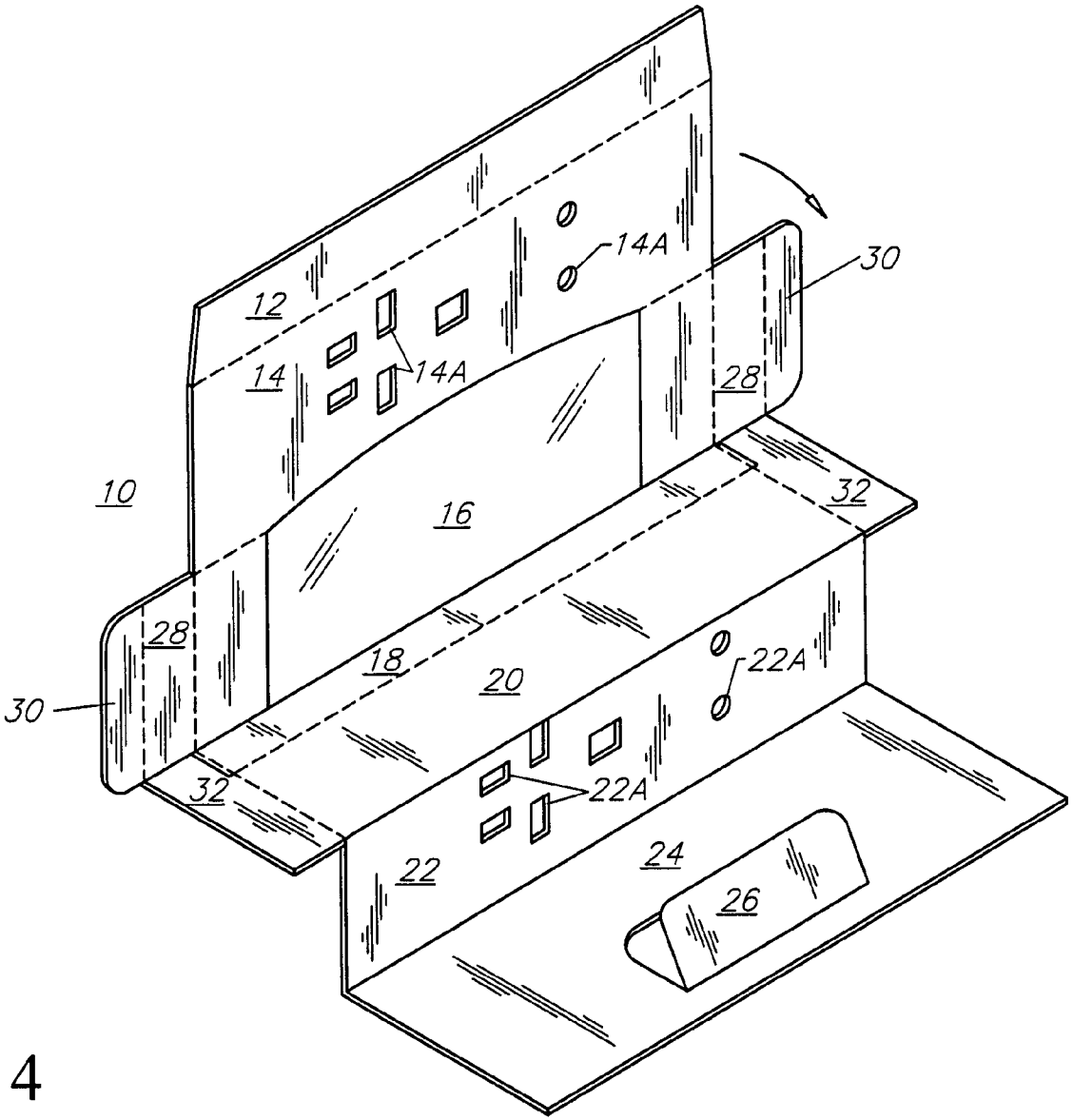
FIG. 4 is a perspective view illustrating a second partially assembled configuration.
Figure 5:
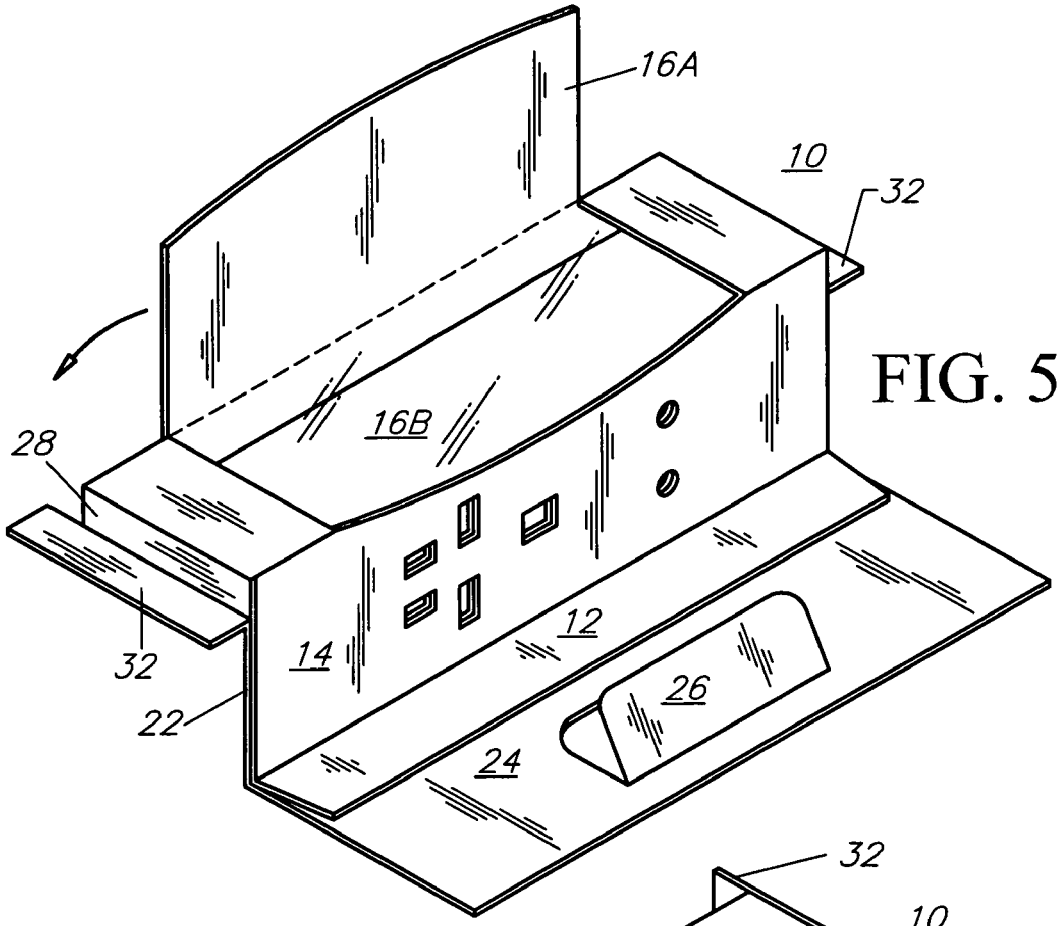
FIG. 5 is a perspective view illustrating a third partially assembled configuration.
Figure 6:
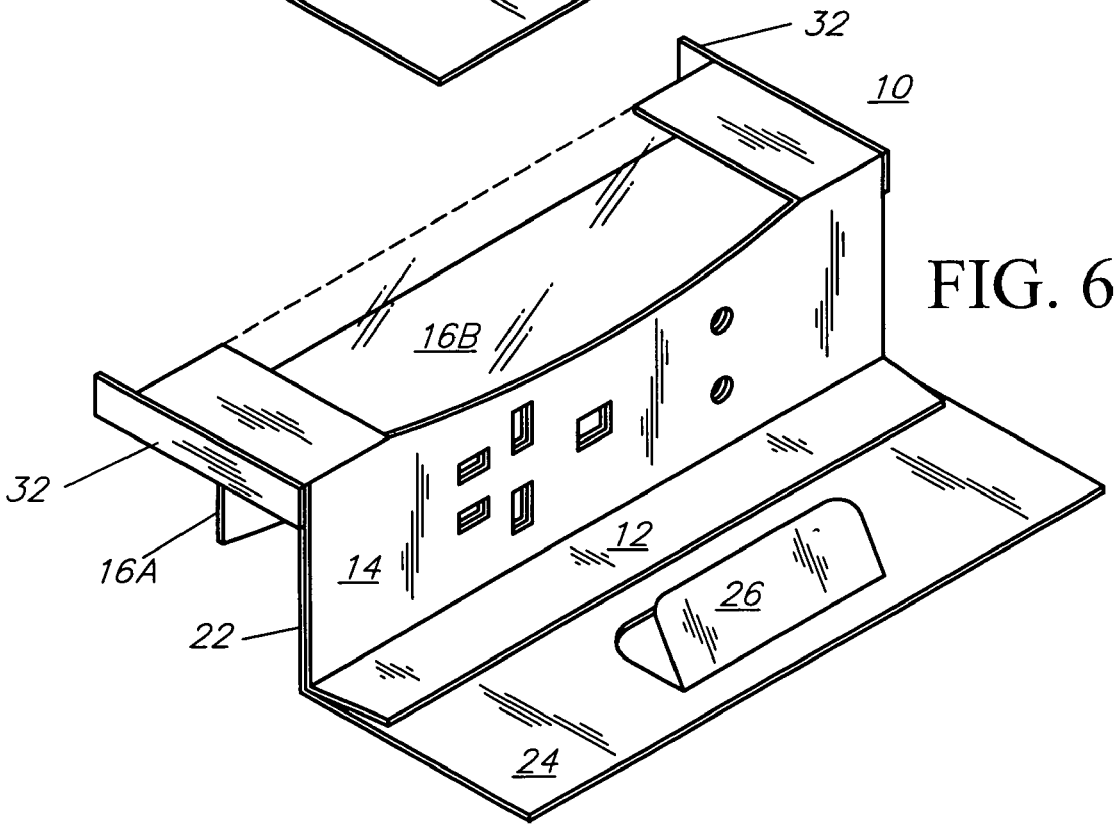
FIG. 6 is a perspective view illustrating a fully assembled configuration.

FIGS. 1 and 2 depict carton 10 in a flat, unfolded configuration. Carton insert 10 is fabricated from a single piece of cardboard that is die-cut into the shape seen in FIGS. 1 and 2. Carton insert 10 includes a plurality of discrete sections, referenced as 12, 14, 16, 18, 20, 22, 24, and 26, and further includes laterally projecting sections 28, 30, and 32. The carton sections are defined by creases (shown in dashed line) to facilitate folding along the various crease lines as discussed herein below.

Carton insert 10 is transformed into shape by folding sections 22 and 24 such that section 22 is generally at 90-degree angles to both sections 20 and 24, whereby section 24 forms a horizontally disposed base, section 22 forms a vertically disposed wall and section 20 forms a horizontally disposed platform. Next, sections 12–18 are folded upward relative to section 20 such that section 18 forms a vertical side wall with respect to horizontal section 20. Next, section 16 is folded 90-degrees relative to section 18 so as to be parallel in spaced relation with respect to section 20 thereby forming a top cover. In addition, sections 28 and 30 are folded inward such that sections 28 are folded 90-degrees relative to section 16 with section 30 folded an additional 90-degrees relative to section 28 so as to be in adjacent parallel relation with section 20. Finally, section 14 is folded 90-degrees relative to section 16 so as to be in adjacent parallel relation with section 22, and section 12 is folded 90-degrees relative to section 14 so as to be in adjacent parallel relation with section 24. An adhesive is used to secure section 12 to section 24. Section 16 includes a flap, referenced as 16A, which is folded into a vertically disposed configuration thereby functioning as a support leg for the chamber defined by sections 16, 18, and 20.

Once folded into the intended configuration, carton 10 defines a chamber, bounded by section 20 (floor), section 18 (side wall), section 16 (top cover) having an opening covered by a transparent window 16B for viewing the contents, a portion of section 14 (side wall), and sections 28 (opposing end walls). Carton insert 10 is designed for insertion within a larger box for maintaining the device within the box in a configuration that allows for visual inspection of the device while preventing damage to the device as a result of shock during transit.

A significant aspect of the invention involves the use of a stretchable transparent film material 16B affixed to section 16 in covering relation with the opening created by folding over of flap 16A. More particularly, material 16B comprises a transparent film having elastic qualities. When an electronic device is placed in the carton chamber and section 16 is folded thereover, the transparent film stretches to conform to the top surface of the device thereby placing the device in mild compression. Accordingly, the transparent film 16B functions both as a window and to secure the device in place. The stretchable film allows carton 10 to be used with various sized devices since the material is capable of stretching to accommodate different sizes.

Carton insert 10 further includes a plurality of apertures strategically located and spaced for receiving and securing accessories, such as charging units, therein so as to anchor the accessories within the packaging. More particularly, sections 22 and 14 of carton 10 further define a plurality of apertures, referenced as 22A and 14A, which are aligned when carton insert 10 is in the fully assembled folded configuration depicted in FIG. 6. The apertures are configured and positioned so as to be capable of receiving projecting portions of various device accessories, such as the prongs of an electrical re-charging unit, so as to anchor the accessories within the box during shipping and transit. Sections 22 and 14 preferably include both rectangular and circular openings so as to accommodate a wide variety of accessories.

II. Alternate Embodiment

FIGS. 7–11 depict an alternate embodiment for a universal packaging carton insert, generally referenced as 100, for use in packaging cellular telephones and other hand-held electronic devices. Alternate embodiment insert 100 is formed from a single piece of cardboard that is die-cut and folded so as to form a packaging container suitable for housing a wide variety of cellular telephones and accessories.

Figure 7:
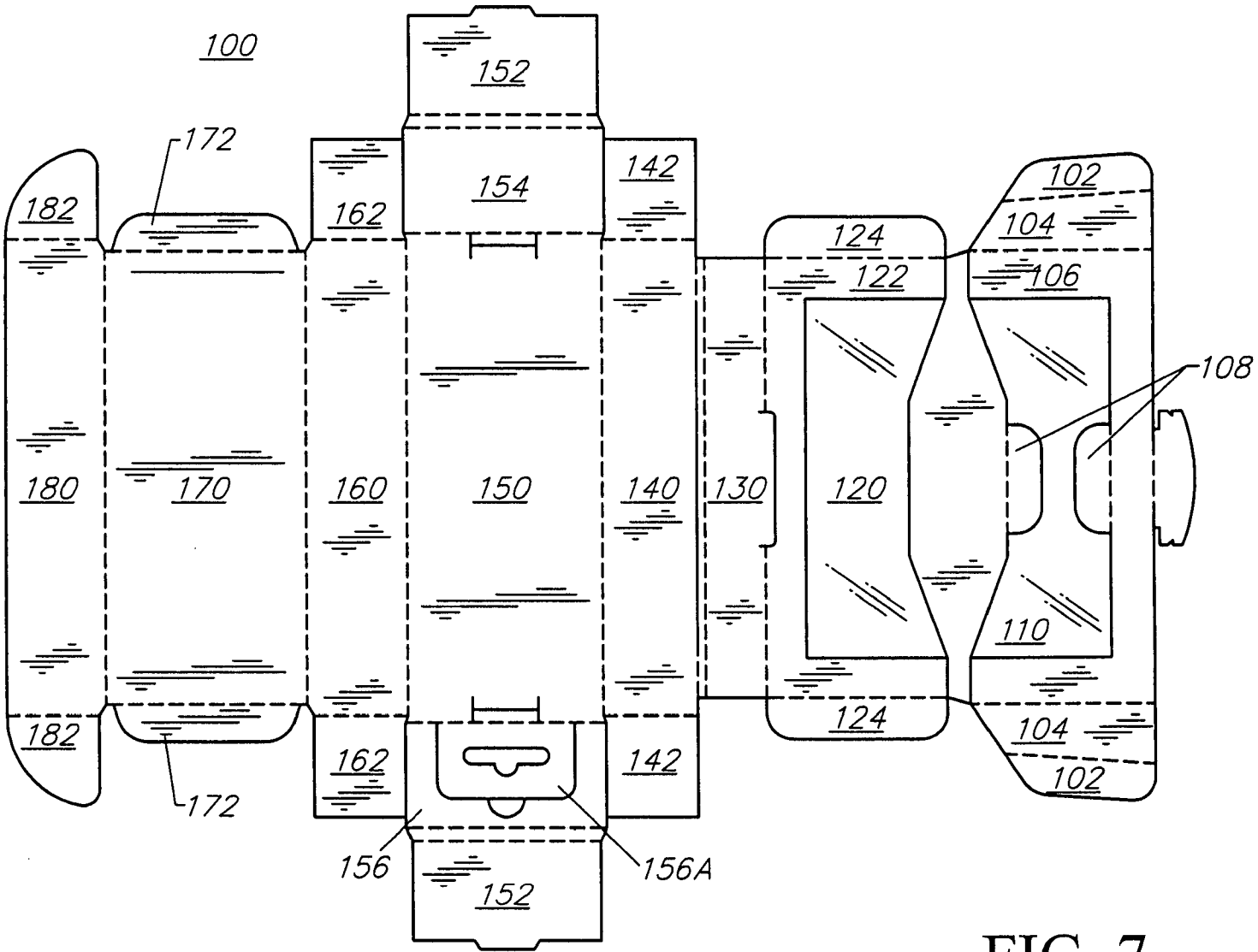
FIG. 7 is top plan view of an alternate embodiment die-cut package insert according to the present invention.
Figure 8:
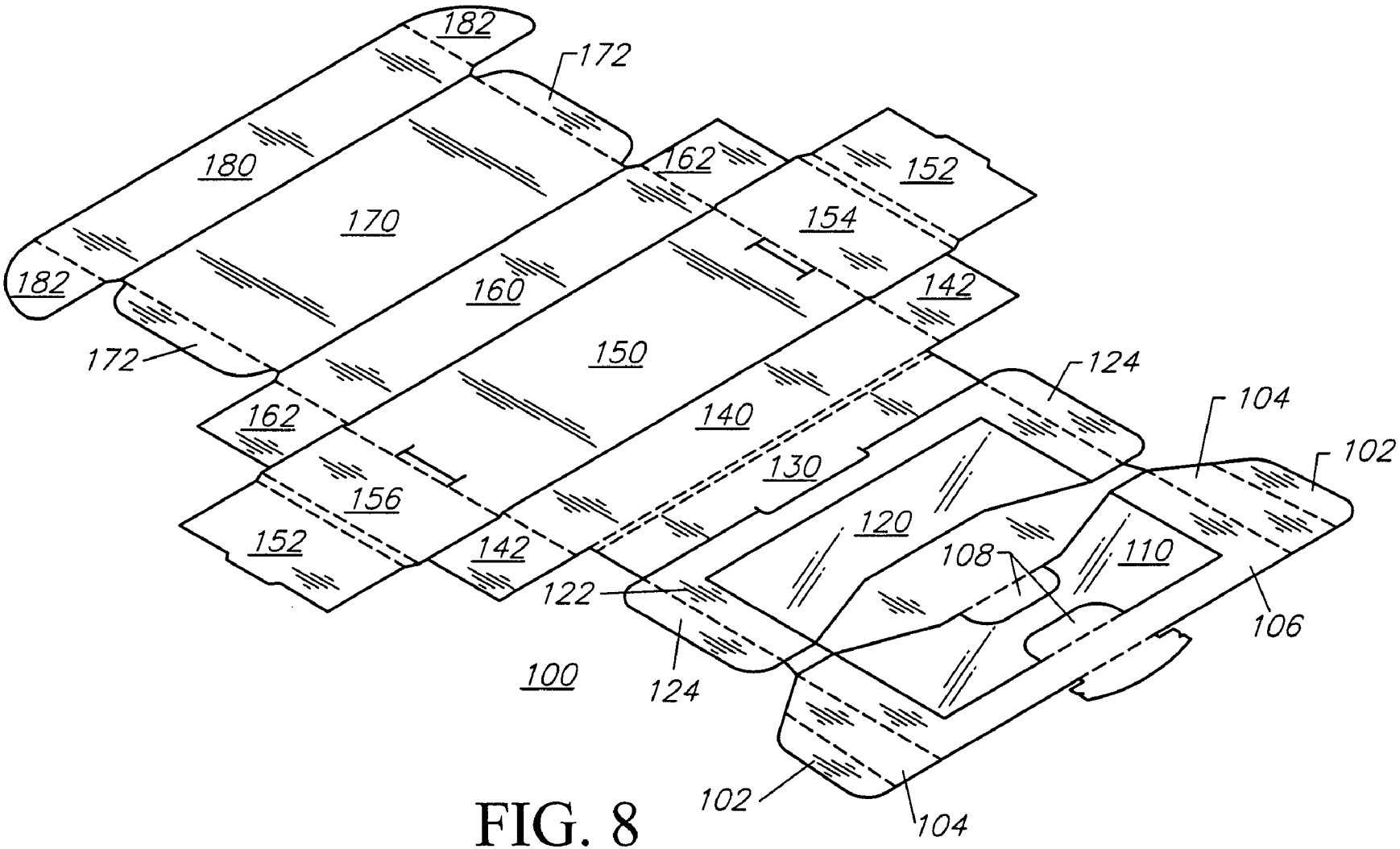
FIG. 8 is a perspective view thereof.

FIGS. 7 and 8 depict carton 100 in a flat, unfolded configuration. Carton 100 is fabricated from a single piece of cardboard that is die-cut into the shape best seen in FIG. 7. Carton 100 includes a plurality of discrete sections, referenced as 110, 120, 130, 140, 150, 160, 170, and 180. Sections 110 and 120 define cutout portions covered by transparent stretchable film for reasons set forth more fully herein below. The carton sections are defined by creases (shown in dashed line) to facilitate folding along the various crease lines as discussed herein below.

Figure 9:
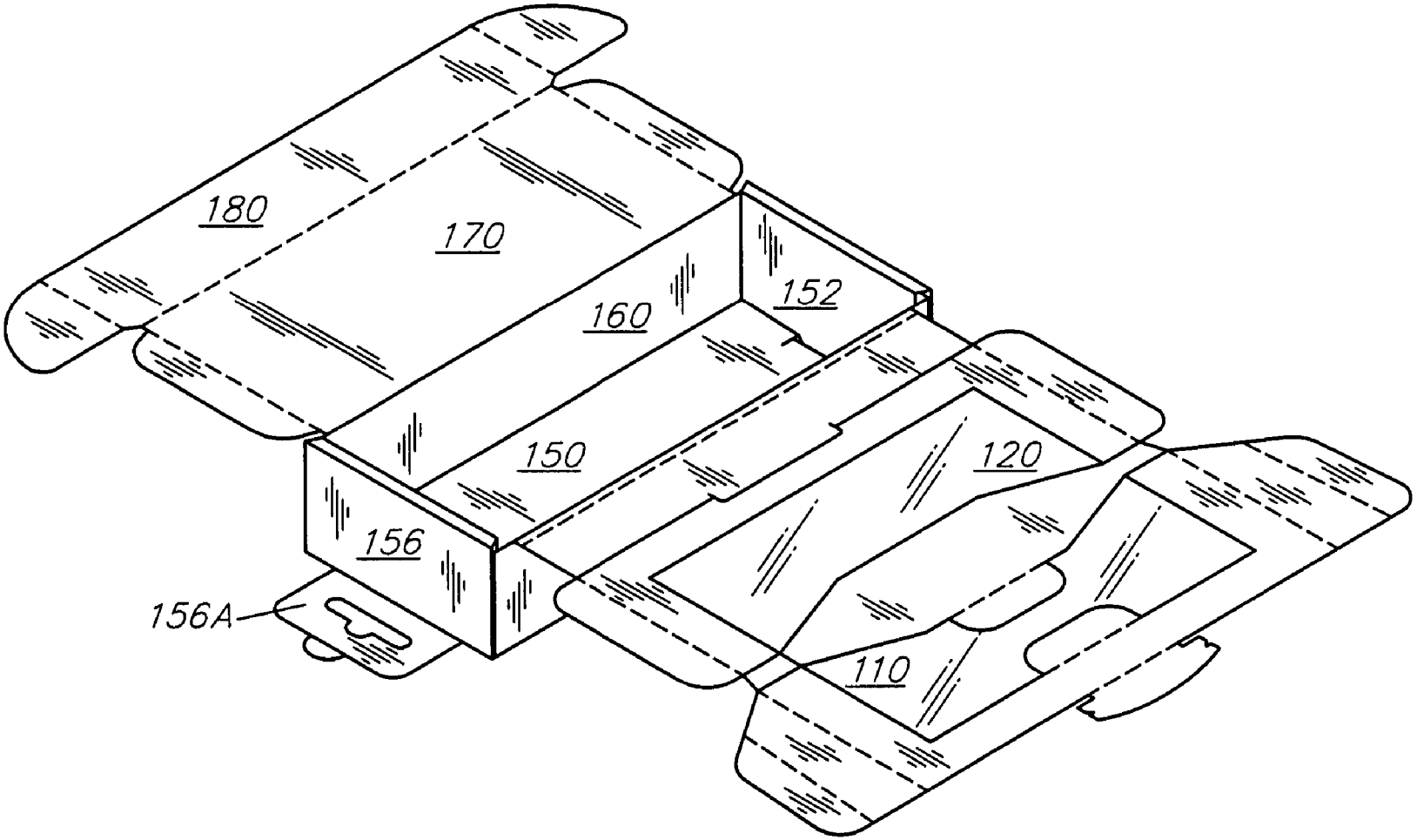
FIG. 9 is a perspective view illustrating a first partially assembled configuration.

Carton 100 is transformed from the shape depicted in FIG. 8 to the shape depicted in FIG. 9 by folding sections 140, 150, and 160, such that section 150 forms a horizontal base, sections 140 and 160 form opposing side walls, and sections 142, 152, 154, 162 form a first end wall, while sections 142, 152, 156, and 162 form a second end wall. Next, sections 110, 120, and 130 are folded over into the volume defined by previously folded sections 140–160, such that section 120 forms a base for holding an electronic device, such as a cellular phone, and section 110 forms a top cover therefor. Projecting sections 102 and 104, are folded upward such that sections 102 form horizontally projecting flanges, which cooperate with sections 108 to retain software, such as manuals and other written materials shipped along with the electronic device as depicted in FIG. 10.

Figure 10:
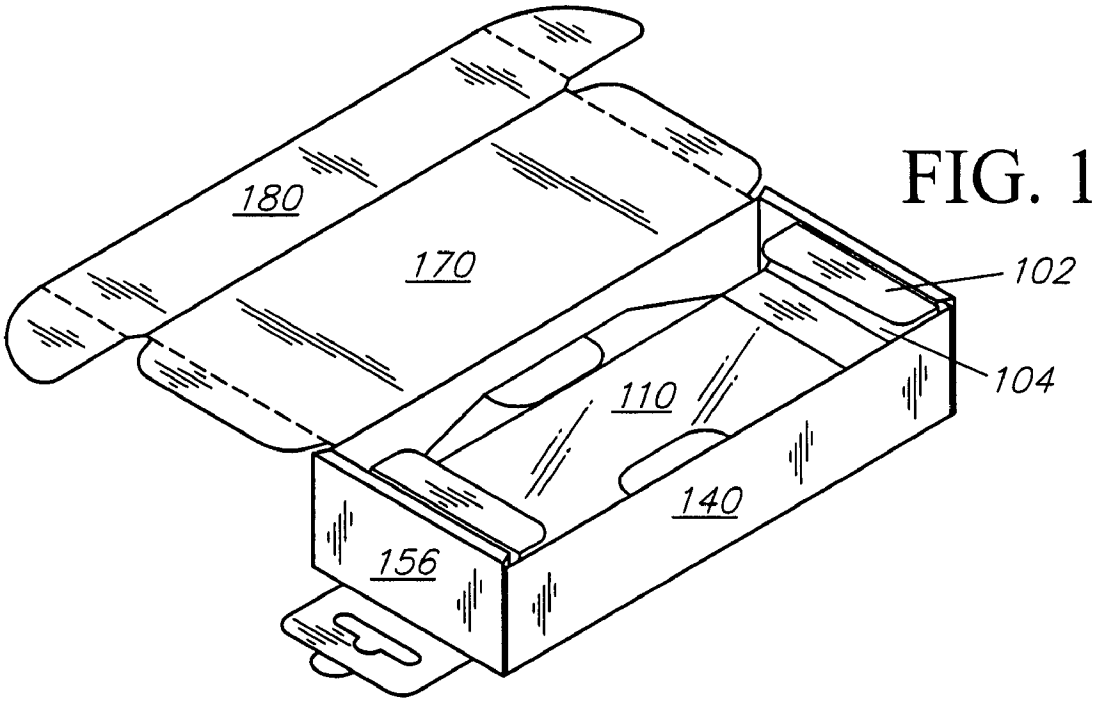
FIG. 10 is perspective view illustrating a second partially assembled configuration.
Figure 11:
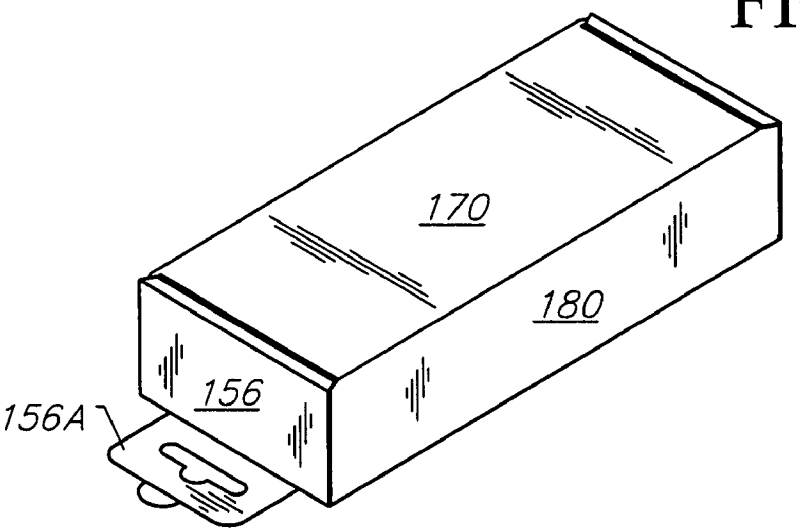
FIG. 11 is a perspective view illustrating a fully assembled configuration.

Sections 170 and 180 function as a cover as best depicted in FIGS. 10 and 11. More particularly, section 170 folds over the top of the carton to form a top with sections 172 folding into the internal volume defined by sections 140, 150 and 160. Section 180 folds over the side thereby covering the external surface of section 140, with sections 182 folding ninety degrees relative to section 180 for insertion within the gaps formed adjacent to sections 154 and 156 respectively.

In the fully assembled configuration depicted in FIGS. 10 and 11, an electronic device, such as a cellular telephone, may be conveniently packaged therein, sandwiched between the transparent film attached to sections 110 and 120. More particularly, once folded into the intended configuration, carton 100 defines a chamber, bounded by a floor (section 120), opposing side walls (sections 140 and 160), and a top cover (section 170). Within the chamber is a secondary chamber for receiving the electronic device. The secondary chamber is defined primarily by sections 110 and 120 whereby the stretchable transparent film conforms to the shape of the enclosed device thereby maintaining the device in proper position while enabling visual inspection upon opening of cover 170.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A packaging insert adapted for use with hand-held electronic devices to maintain the devices within a larger carton, said packaging insert comprising:

a sheet of die-cut material including a plurality of creases dividing said sheet into a plurality of sections including first, second, third, fourth, fifth, sixth, and seventh sections;

said sheet configurable from a generally flat configuration to a folded configuration wherein:

said first section forms a horizontal base;

said second section forms a first vertical wall projecting upward from said base;

said third section forms a horizontal floor projecting laterally from said vertical wall;

said fourth section forms a second vertical wall projecting upward from said horizontal floor;

said fifth section projects horizontally from said second vertical wall in parallel spaced relation with said horizontal floor to form a cover;

said sixth section projects vertically downward from said cover in substantially adjacent overlapping relation with said second section;

said seventh section projects horizontally from said sixth section in substantially adjacent overlapping relation with said first section.

2. A packaging insert according to claim 1, wherein said fifth section includes a portion thereof forming a flap whereby folding away of said flap exposes an opening, said opening covered with a transparent film.

3. A packaging insert according to claim 2, wherein said transparent film is stretchable.

4. A packaging insert according to claim 1, wherein said second and sixth sections define a plurality of apertures positioned so as to be in substantially aligned relation when said insert is in the folded configuration, whereby said apertures may receive projecting members of charging accessories thereby anchoring said charging accessories in place.

* * * * *